US006361111B1

(12) United States Patent
Bowers et al.

(10) Patent No.: US 6,361,111 B1
(45) Date of Patent: Mar. 26, 2002

(54) ROTATIONAL ADJUSTMENT DEVICE

(75) Inventors: Daniel P. Bowers, Glassboro; Russell Guise, Franklinville; Mark J. Hoskin, Mays Landing, all of NJ (US)

(73) Assignee: Electric Mobility Corporation, Sewell, NJ (US)

( * ) Notice: Subject to any disclaimer, the term of this patent is extended or adjusted under 35 U.S.C. 154(b) by 0 days.

(21) Appl. No.: 09/441,873

(22) Filed: Nov. 17, 1999

Related U.S. Application Data

(60) Provisional application No. 60/109,070, filed on Nov. 18, 1998.

(51) Int. Cl.[7] ..... A47C 1/02
(52) U.S. Cl. ..... 297/344.22
(58) Field of Search ..... 297/440.22, 344.22, 297/344.26, 344.21; 248/418, 425

(56) References Cited

U.S. PATENT DOCUMENTS 809,944 A * 1/1906 Hanger
1,674,686 A * 6/1928 Masury
2,845,990 A * 8/1958 Hubert
3,659,895 A * 5/1972 Dresden
3,975,050 A * 8/1976 McKee
4,231,539 A * 11/1980 Sandham
4,518,139 A * 5/1985 Barfell
4,844,543 A * 7/1989 Ochiai
4,977,848 A * 12/1990 Currey
5,431,362 A * 7/1995 Carnahan et al.
5,482,354 A * 1/1996 Gryp
5,702,084 A * 12/1997 Carnahan et al.
5,733,006 A * 3/1998 Woods

* cited by examiner

*Primary Examiner*—Milton Nelson, Jr.
(74) *Attorney, Agent, or Firm*—Frijouf, Rust & Pyle, P.A.

(57) ABSTRACT

An apparatus is disclosed for adjusting the rotational position of a chair comprising a pedestal supporting a radially outwardly extending flange. A seat base is secured to the seat and adapted for rotational connection with the pedestal for enabling rotation of the seat. A plurality of notches are defined about the flange. The lever pivot is secured to either a right or a left pivot mountings for pivoting the lever pivot in either a right or a left position for accommodating for a right-handed or left-handed operator seated in the seat. The notch pin extends from the lever for engaging with one of the plurality of notches for locking the rotational position of the seat base relative to the pedestal.

19 Claims, 13 Drawing Sheets

ROTATIONAL ADJUSTMENT DEVICE

CROSS-REFERENCE TO RELATED APPLICATIONS

This application claims benefit of U.S. Patent Provisional application Ser. No. 60/109,070 filed Nov. 18, 1998. All subject matter set forth in provisional application Ser. No. 60/109,070 is hereby incorporated by reference into the present application as if fully set forth herein.

BACKGROUND OF THE INVENTION

1. Field of the Invention

This application relates to an adjustment device for adjusting the rotational position of a seat and more particularly to a novel and simple rotational adjustment device for adjusting the position of a seat relative to a pedestal.

2. Prior Art Statement

Persons with partial and total walking disabilities have traditionally relied upon wheelchairs for locomotion. Wheelchairs generally have relatively widely spaced wheels for lateral stability and to comfortably accommodate the occupant. Persons in wheelchairs can move with relative ease in places such as hospitals which are usually provided with extra wide doors and halls and inclined ramps between vertically displaced levels. However, private homes and work places are generally not planned specifically to accommodate wheelchairs. While wheelchairs are generally resistant to lateral tipping, wheelchairs are often designed for tipping backwards so that an attendant pushing a patient in a wheelchair can tip the front wheels up to negotiate such obstacles as steps, thresholds, and the like. While such a configuration is useful when the wheelchair is pushed by an attendant, the design presents some hazards when the wheelchair occupant attempts to wheel himself up a ramp.

In order to overcome some of the problems associated with wheelchairs, the medical equipment industry has developed small personal mobility vehicles as an alternative. Such vehicles generally have a pair of powered rear wheels and a steerable front wheel and in general have the appearance of a downsized golf cart. The track of the rear wheels is generally narrower than a wheelchair, the wheel base is generally longer than a wheelchair, and the vehicles are usually designed for tight turning radii such that the vehicles are more maneuverable than a wheelchair and, therefore, more useful in places which are not specifically designed for wheelchair use.

Many personal mobility vehicles have a conventional seat mounted upon a pedestal extending from a frame of the personal mobility vehicles. The conventional seat is similar to a conventional chair having a back portion and a seat portion. Typically, the seat is rotational relative to the frame.

Various types of devices have been provided by the prior art for adjusting the rotational position of the seat relative to the frame. Many of these devices incorporated complex lever assembly for adjusting the rotational position of the seat relative to the frame. Others in the prior art have attempted to use other devices to adjust the rotational position of the seat relative to the frame.

U.S. Pat. No. 809,444 to Hanger discloses a chair, the combination of a base, a support revolvable mounted on the base, a back hinged to the support, the support extending underneath the seat and being hinged to the back at or near a line passing through the vertical center thereof, means for adjusting the seat and back relatively to each other, and means for securing the back and seat against movement after the desired adjustment has been made, substantially as described.

U.S. Pat. No. 1,674,686 to Masury discloses a combination with the back and arm frames of a hammock, of a member secured to the back and having a cam face extending toward the forward side of the back and a stud, the cam face being eccentric with relation to the stud, a co-acting socket member secured to the arm frame and having an opening to receive the stud, the cam face being arranged to engage with a part carried by the arm frame.

U.S. Pat. No. 2,845,990 to Hubert discloses a vehicle seat construction comprising: a longitudinally extending platform member adapted for affixment to a vehicle; a base-plate member positioned over the platform member, means adjustably attaching the base-plate to the platform and operative to permit relative fore-and-aft movement between the base-plate and the platform; releasable pin means interlocking the base-plate to the platform in any one of a plurality of fore-and-aft displaced positions of the base-plate relative to the platform; a seat; mounting means pivotally mounting the seat above the base-plate to permit rotation of the seat about a vertical axis; the pivotal mounting means being disposed so that the vertical axis about with the seat rotates falls within the perimeter of the seat and additionally is transversely displaced a substantial distance from a vertically and longitudinally extending plane that passes through the fore-and-aft axis of symmetry of the seat; and releasable means operative to interlock the seat with the mounting means in any one of a plurality of relative rotated positions therebetween.

U.S. Pat. No. 3,975,050 to McKee discloses a unit of hardware for reclinably adjustable seating of vehicle driver and/or passenger and adapted to be swiveled into selected position, and comprising a pedestal rotatably receiving a socket positionably locked thereto, and a stop plate positionably locked in reclined positions by a toggle pin carried into tight engagement therewith by a manually releasable lever operated shackle, the tilt being positively restricted.

U.S. Pat. No. 4,231,539 to Sandham discloses an improved seat base for a swivel type seat in which the base's seat support and pedestal are connected together in swivel relation by a thrust bearing of inverted conical configuration. In preferred form, a latch dog is movable between a latch position defined by a latch seat in the outer bearing collar for preventing swivel type rotation of the seat, and a release position where the latch dog is withdrawn from the latch seat into the interior of the thrust bearing for allowing swivel type rotation of the seal. The latch dog is pivotable on a horizontal axis oriented above the thrust bearing between those two positions through a latch post in the inner bearing collar by use of a lift arm connected thereto, the lift arm having a handle located adjacent to the seat's front edge.

U.S. Pat. No. 4,518,139 to Barfell discloses an improved pedestal for a rotatable seat which includes a shiftable pivot arm and associated latch part. The arm and latch cooperate with a flange of the pedestal support member to secure the plate against detachable lifting during normal seat rotation.

U.S. Pat. No. 5,733,006 to Woods discloses a seat swivel assembly which allows a seat to swivel between stationary positions or to freely swivel about an axis, having an upper swivel plate and a lower swivel plate, a swivel member rotatably mounted to one of the plates, a swivel actuator lever in communication with the swivel member, a free-swivel latch facilitating unencumbered free swivel of the swivel plate, and a release lever in communication with the free swivel latch to release the swivel member to prevent free swivel.

Unfortunately, many of these devices have the distinct disadvantage of being overly complex, heavy and expensive.

In addition, these devices did not have the ability for accommodating for a right-handed or a left-handed operator sitting in the chair.

One important application for an adjustment device for adjusting the rotational position of a seat relative to a frame is in the application of personal mobility vehicles. A personal mobility vehicle presents special concerns in the design of an adjustment device for adjusting the rotational position of a seat relative to a frame. Firstly, a personal mobility vehicle must be light weight to provide utmost convenience for the user. Secondly, the operation of the adjustment device must be simple to allow adjustment with the minimum number of tools. Thirdly, the adjustment device must provide a positive support in the remote event of any slippage of the adjustment device. Fourthly, the adjustment device must have the ability for accommodating for a right-handed or a left-handed operator sitting in the seat Therefore it is an object of the present invention to provide an adjustment device for adjusting the rotational position of a seat wherein the adjustment device comprises a flange having a plurality of notches cooperating with a lever having a notch pin for engaging with one of the plurality of notches for locking the rotational position of the seat.

Another object of this invention is to provide an adjustment device for adjusting the rotational position of a seat wherein the seat may be secured in a number of rotational positions.

Another object of this invention is to provide an adjustment device for adjusting the rotational position of a seat wherein the adjustment device must have the ability for accommodating for a right-handed or a left-handed operator sitting in the seat.

Another object of this invention is to provide an adjustment device for adjusting the rotational position of a seat wherein the adjustment device is fail safe to limit the rotational movement of the seat.

Another object of this invention is to provide an adjustment device for adjusting the rotational position of a seat wherein the rotational position of the seat is automatically secured in the next rotational position.

Another object of this invention is to provide an adjustment device for adjusting the rotational position of a seat wherein the adjustment device has the ability for accommodating for a right-handed or a left-handed operator sitting in the seat.

Another object of this invention is to provide an adjustment device for adjusting the rotational position of a seat which is economical and easy to manufacture.

Another object of this invention is to provide an adjustment device for adjusting the rotational position of a seat which is light weight for use on personal mobility vehicles.

The foregoing has outlined some of the more pertinent objects of the present invention. These objects should be construed as being merely illustrative of some of the more prominent features and applications of the invention. Many other beneficial results can be obtained by applying the disclosed invention in a different manner or modifying the invention with in the scope of the invention. Accordingly other objects in a full understanding of the invention may be had by referring to the summary of the invention and the detailed description describing the preferred embodiment of the invention.

SUMMARY OF THE INVENTION

A specific embodiment of the present invention is shown in the attached drawings. For the purpose of summarizing the invention, the invention relates to an apparatus for adjusting the rotational position of a chair comprising a pedestal defining a pedestal axis extending through the pedestal. A flange is supported by the pedestal with the flange extending radially outwardly relative to the pedestal axis. A seat base is adapted to be secured to the seat with a shaft extending from the seat base and adapted for rotational connection with the pedestal for enabling the seat to rotate relative to the pedestal. A plurality of notches are defined in a spaced apart relationship about the flange. A lever has a handle portion located at a first end of the lever and a notch pin located at a second end of the lever with a lever pivot defined therebetween. A right and a left pivot mounting are defined in the seat base. The lever pivot is secured to one of the right and left pivot mountings for mounting the lever pivot in one of a right position and a left position on the seat base for accommodating for a right-handed operator or a left-handed operator seated in the chair. The notch pin engages with one of the plurality of notches for locking the rotational position of the seat base relative to the pedestal.

In a more specific example of the invention, the pedestal is a hollow tube being in a substantially vertical orientation. The shaft extends from the seat base for insertion into the pedestal for rotationally mounting the seat base relative to the pedestal. The shaft is removable from the pedestal for removing the seat from the pedestal. The flange is formed of a metallic material and the seat base has a portion formed from a polymeric material for providing a rotational bearing surface with the flange. The notch pin includes an enlarged end having a greater dimension than the notch for inhibiting removal of the seat base from the pedestal when the notch pin is engaged with the notch.

The flange is a substantially circular flange having an outer circumference with the plurality of notches extending radially inwardly from the outer circumference of the substantially circular flange. Preferably, each of the notches is tapered for facilitating insertion of the notch pin within the notch and for positively locking the notch pin within the notch.

In one example of the invention, the lever is a generally linear flat linear member being symmetric for accommodating for a right-handed operator or a left-handed operator seated in the chair when the lever is secured to one of the right and left positions on the seat base. The right and left pivot mounting includes a right and a left aperture. A shoulder bolt affixes the lever pivot to one of the right and left apertures for pivoting the lever in one of a right position and a left position on the seat base.

A spring coacts between the seat base and the lever for urging the notch pin into engagement with the notch. The lever includes a first and a second lever respite for receiving one end of a spring. A right and a left seat base respite are defined in the seat base for receiving another end of the spring. The spring is contained between the one of the lever respites and one of the seat base respites for urging the notch pin into engagement with the notch.

The foregoing has outlined rather broadly the more pertinent and important features of the present invention in order that the detailed description that follows may be better understood so that the present contribution to the art can be more fully appreciated. Additional features of the invention will be described hereinafter which form the subject matter of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
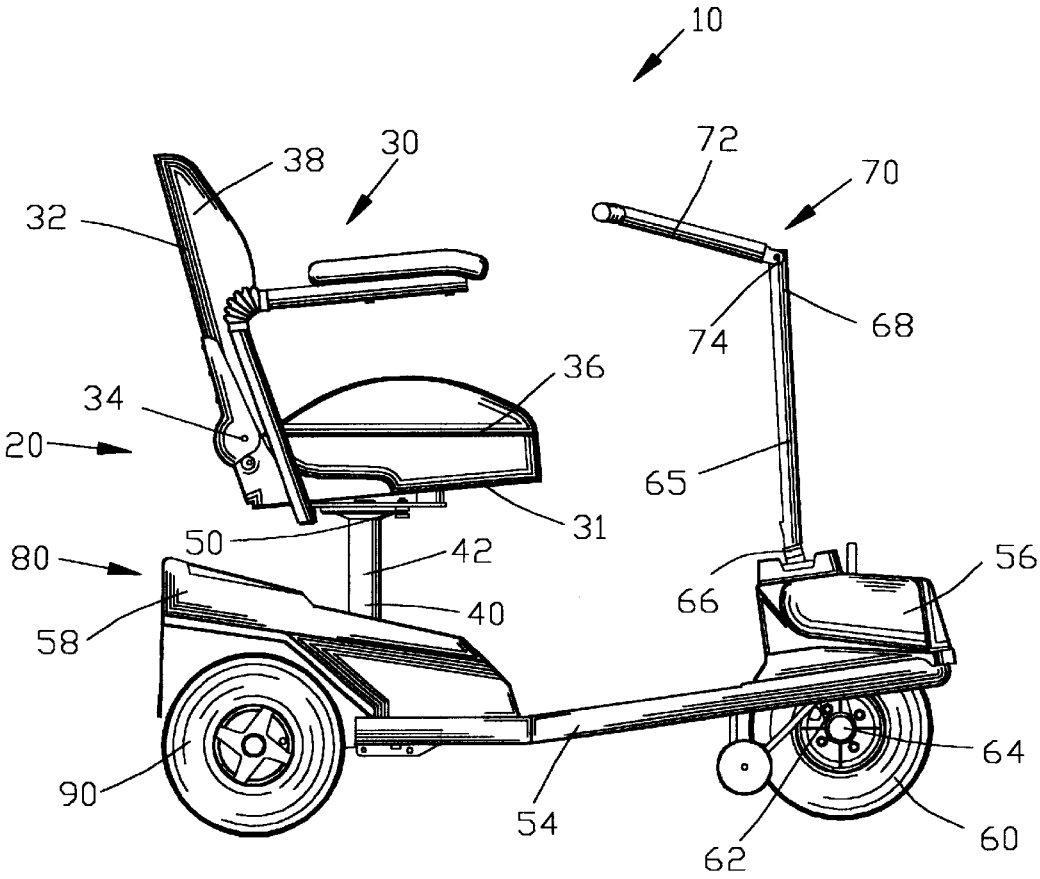
FIG. 1 is a side elevational view of a personal mobility vehicle incorporating the rotational adjustment device of the present invention with the seat being disposed in a first rotational position.

FIG. 1 is a side elevational view of a personal mobility vehicle 10 incorporating the rotational adjustment device 20 of the present invention with the seat assembly 30 being disposed on a pedestal 40 in a first rotational position. The seat assembly 30 is rotatably mounted on the pedestal 40 of the personal mobility vehicle 10. The rotation of the seat assembly 30 is controlled by a lever 50. When the seat assembly 30 is disposed in the first rotational position, an operator positioned on the seat assembly 30 may operate the personal mobility vehicle 10.

Figure 2:
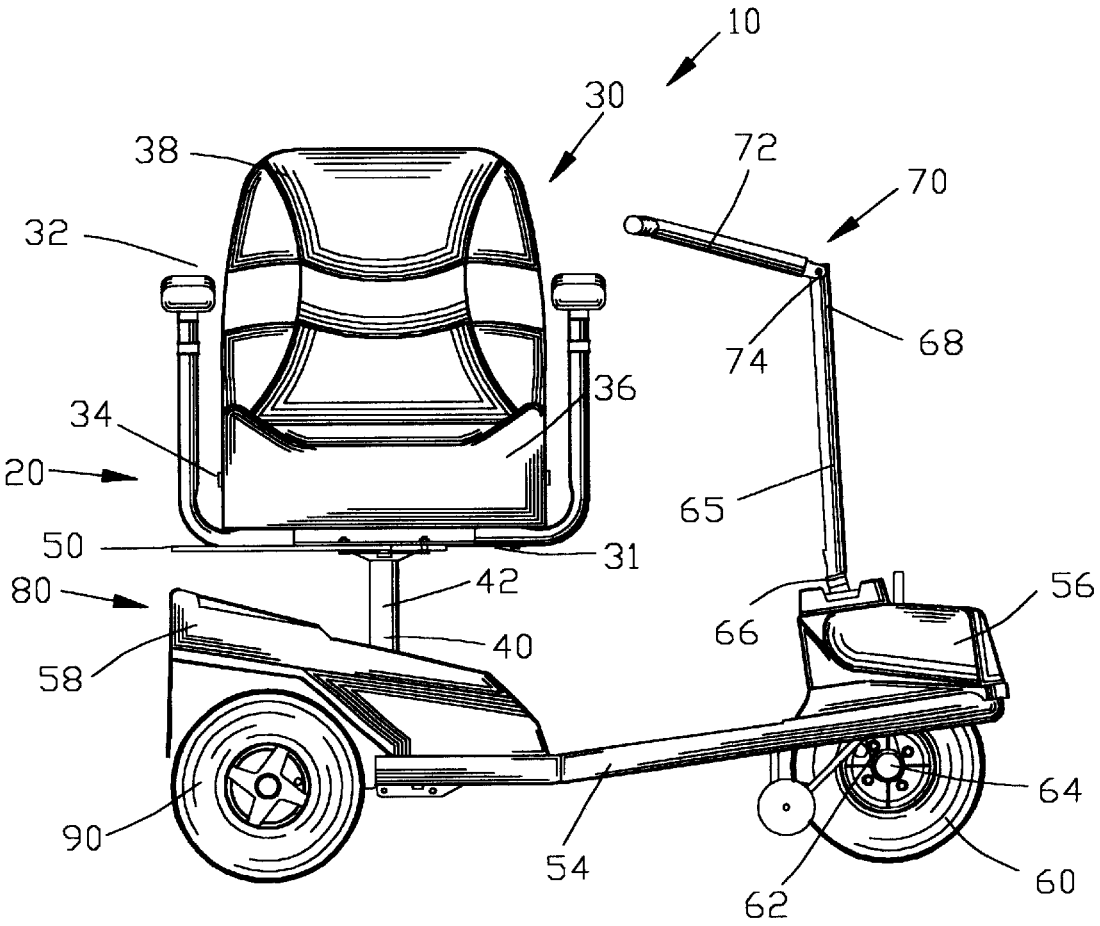
FIG. 2 is a side elevational view of a personal mobility vehicle of FIG. 1 with the seat being disposed in a second rotational position.

FIG. 2 is a side elevational view of a personal mobility vehicle 10 of FIG. 1 with the seat assembly 30 being disposed in a second rotational position. When the seat assembly 30 is disposed in the second rotational position, an operator may conveniently ingress and egress on and off of the personal mobility vehicle 10.

The personal mobility vehicle 10 includes a floor pan unit 54 extending between a front end 56 and a rear end 58 of the personal mobility vehicle 10. The front end 56 of the floor pan unit 54 supports a steerable front wheel 60 controlled by steering gear 70.

The front wheel 60 is rotatably mounted on the fork 62 by a front axle 64 extending between the legs of the fork 62. A stem 65 extends between a lower and an upper end 66 and 68. The fork 62 is connected to the lower end 66 of the stem 65. The stem 65 is rotatably mounted relative to the front end 56 of the floor pan unit 54.

The steering gear 70 includes a tiller 72 pivotally connected to the upper end 68 of the stem 65 by a threaded bolt 74 to adjustably fix the angular position of the tiller 72. A movement of the tiller 72 by an operator causes movement of the front wheel 60 to alter the direction of the personal mobility vehicle 10.

The rear end of the floor pan unit 54 supports a drive unit 80 including rear wheels 90. The drive unit 80 may be of conventional design comprising an electric motor (not shown) powered by a battery pack (not shown) for driving the rear wheels 90 through a transmission (not shown). Control switches (not shown) are conveniently located for enabling an operator to control the speed and the rotational direction of the rear wheels 90.

Preferably, the electric motor is powered by a rechargeable battery (not shown) located within the battery pack or case. The preferred type of battery is of the jelled cell type to avoid leakage of battery chemicals should the battery pack be upset and for the ease of maintenance of such cells. The battery is of the size employed on small boats as starting motors and weighs about twenty pounds.

The pedestal 40 is mounted to the floor pan unit 54 to rotatably support the seat assembly The seat assembly 30 comprises a seat portion 31 and a back portion 32. In this example, the back portion 32 of the seat assembly 30 is pivotably mounted to the seat portion 31 by a pivot 34 for accommodating for the size and comfort of an operator. A seat cushion 36 is disposed on the seat portion 31 whereas a back cushion 38 is disposed on the back portion 32. As will be described in greater detail hereinafter, the seat assembly 30 is rotatable on the pedestal 40 for accommodating for comfort of the operator and for facilitating the ingress and egress on and off of the personal mobility vehicle 10 by the operator.

Figure 3:
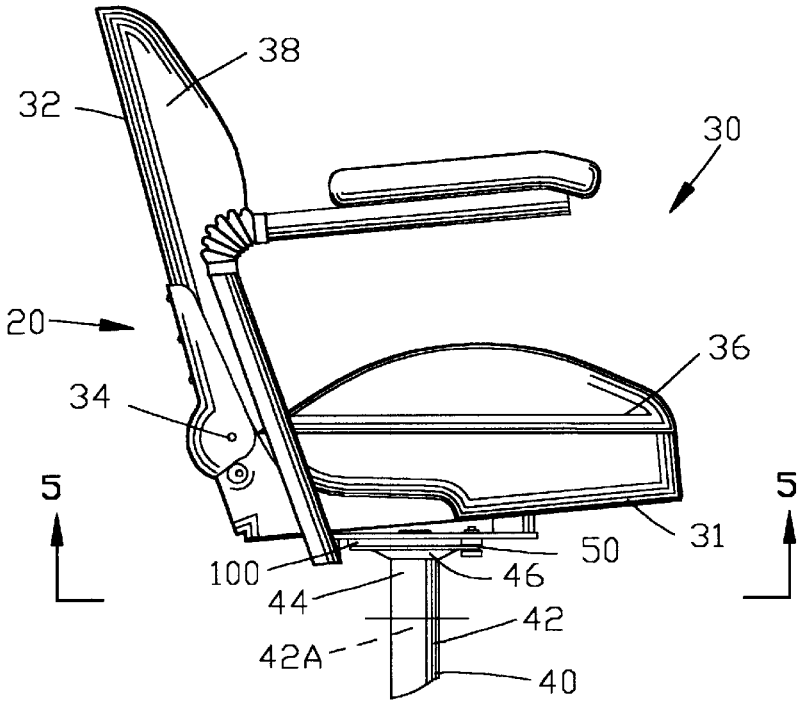
FIG. 3 is an enlarged side elevation view of the seat of the personal mobility vehicle of FIG. 1.
Figure 4:
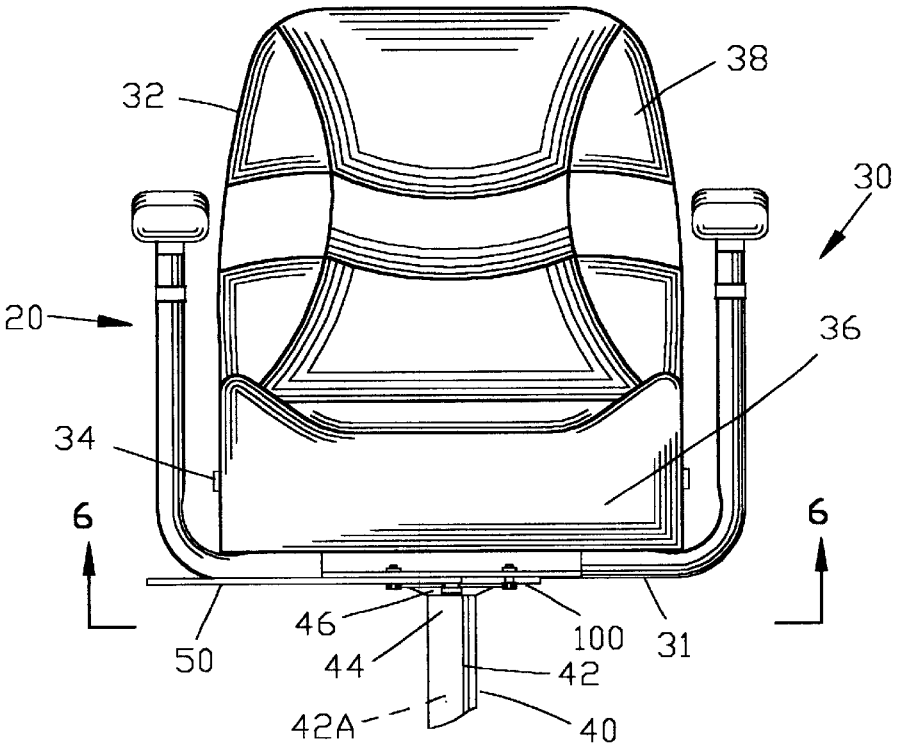
FIG. 4 is an enlarged side elevation view of the seat of the personal mobility vehicle of FIG. 2.

FIGS. 3 and 4 are enlarged side elevation views of the seat assembly 30 of FIGS. 1 and 2. The pedestal 40 comprises a hollow tube 42 having an axis 42A disposed in a substantially vertical orientation. A lower end of the hollow tube 42 is secured to the floor pan unit 54. An upper end 44 of the hollow tube 42 supports a partially conical member 46. The partially conical member 46 is connected to the upper end 44 of the hollow tube 42 by suitable means such as mechanical fasteners, welding or the like.

Figure 5:
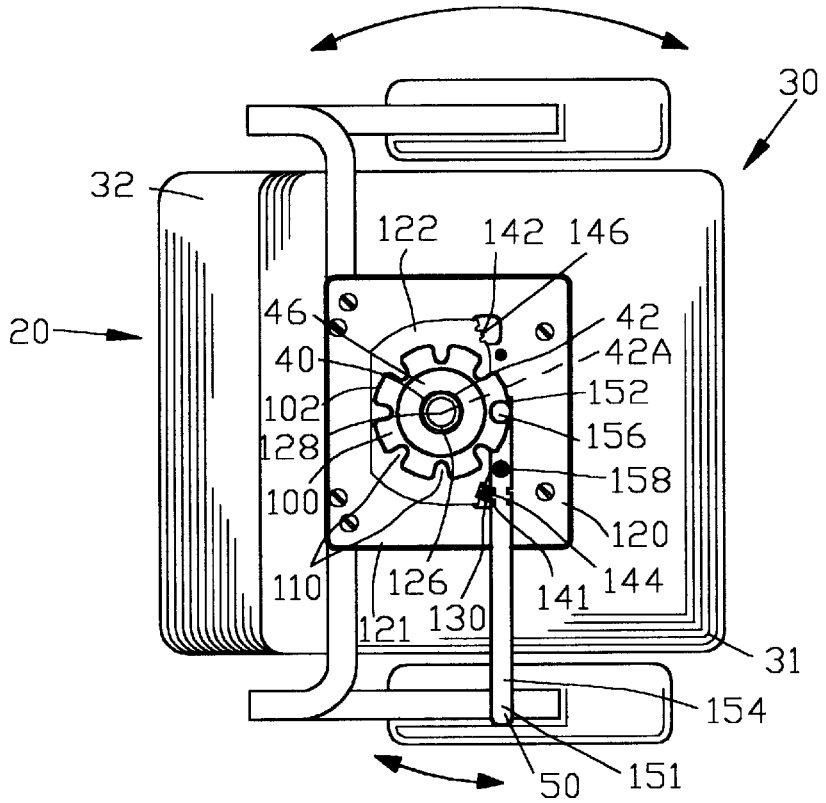
FIG. 5 is a bottom view of the seat of FIG. 3.
Figure 6:
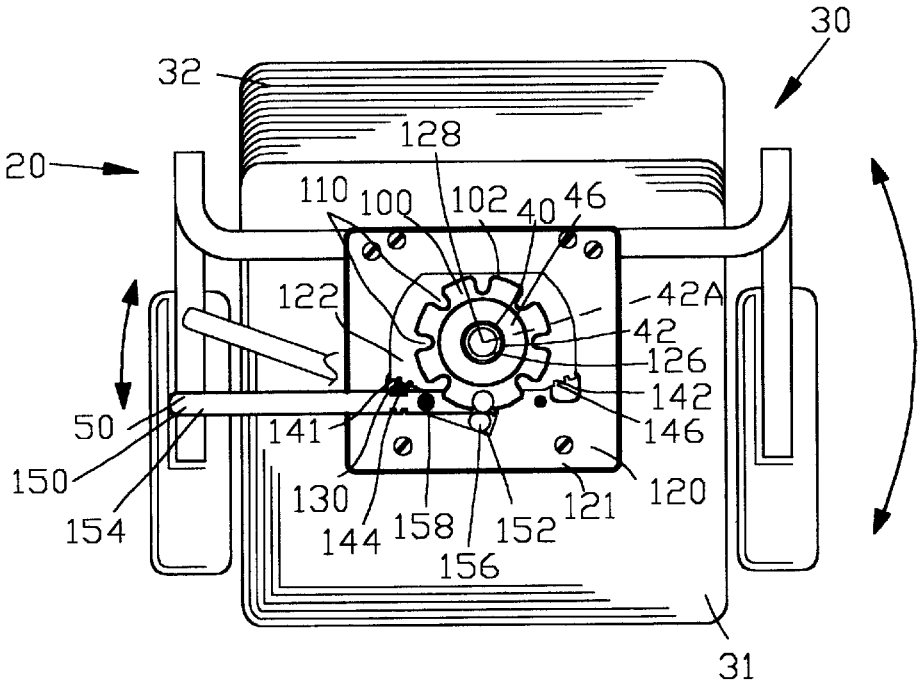
FIG. 6 is a bottom view of the seat of FIG. 4.

FIGS. 5 and 6 are bottom views of FIGS. 3 and 4. The adjustment device 20 comprises a metallic flange 100 connected to the pedestal 40 by the partially conical member 46 of the hollow tube 42. The partially conical member 46 is connected to the flange 100 by suitable means such as mechanical fasteners, welding or the like. The flange 100 is a substantially circular flange 100 having an outer circumference 102. The flange 100 extends radially outwardly relative to the pedestal axis 42A.

Figure 7:
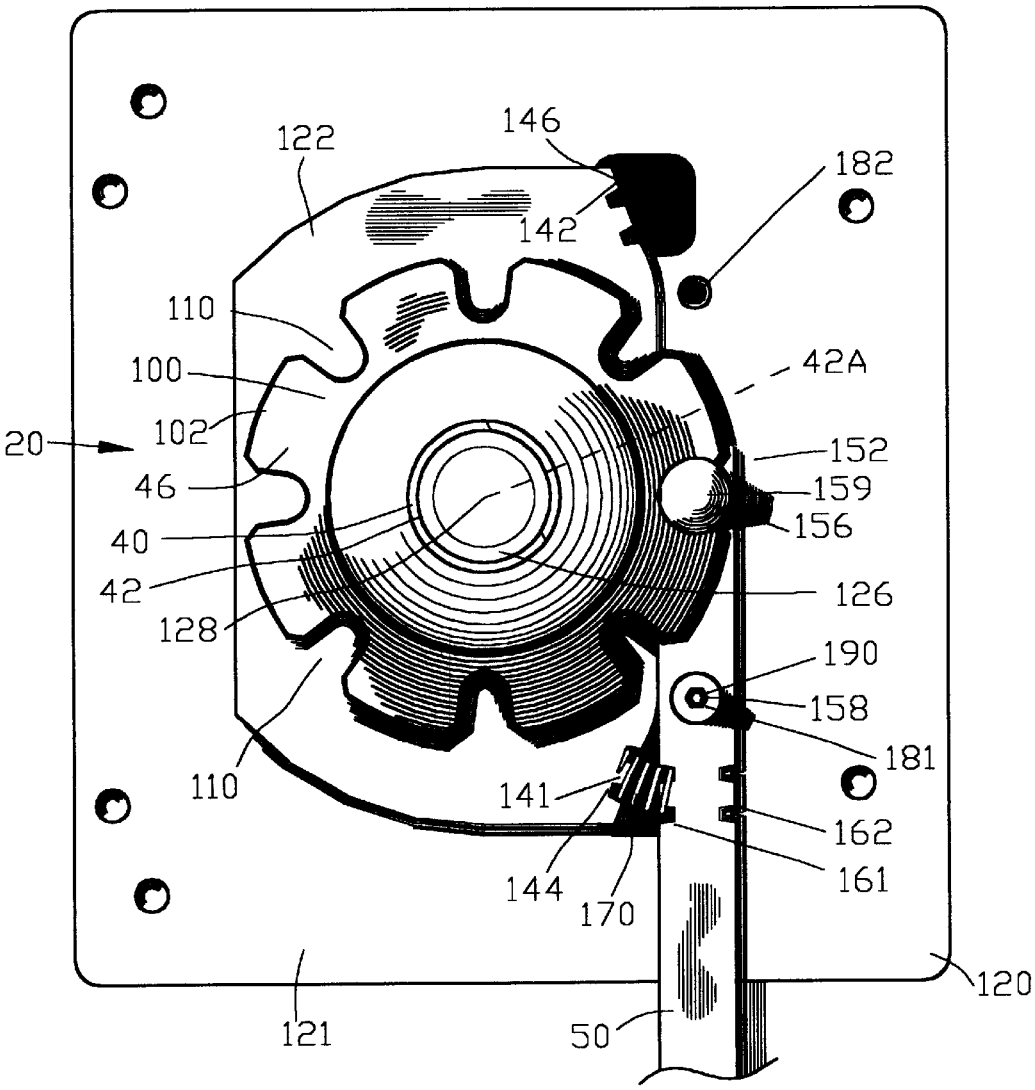
FIG. 7 is an enlarged view of FIG. 5 with an operating lever being located in a right-handed position.
Figure 8:
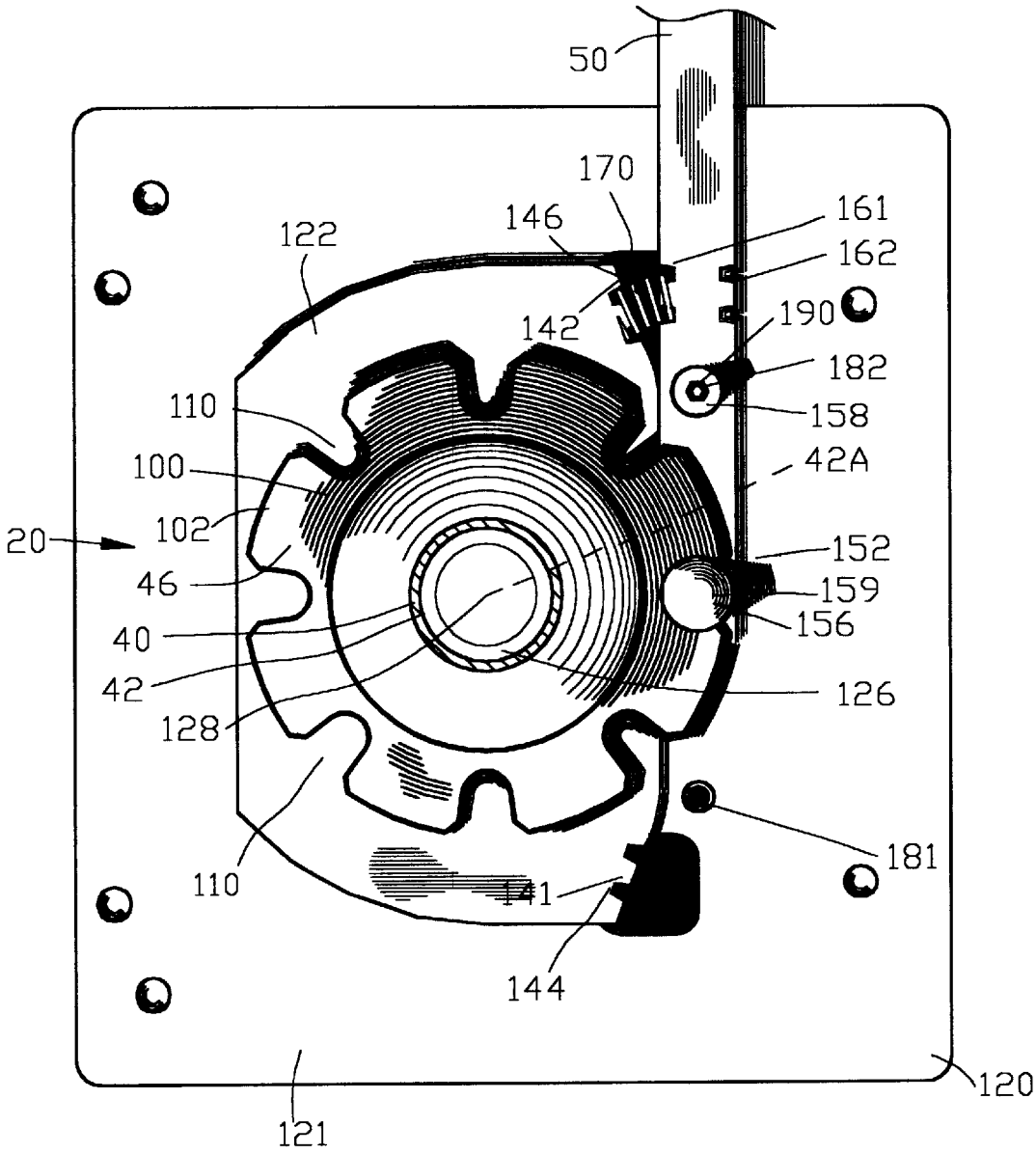
FIG. 8 is an enlarged view of FIG. 5 with the operating lever being located in a left-handed position.

FIGS. 7 and 8 are enlarged views of FIG. 5 with the operating lever 50 being located in a right-handed position and a left-handed position. A plurality of notches 110 are defined in a spaced apart relationship about the flange 100. The plurality of notches 110 extend radially inwardly from the outer circumference 102 of the substantially circular flange 100.

Figure 9:
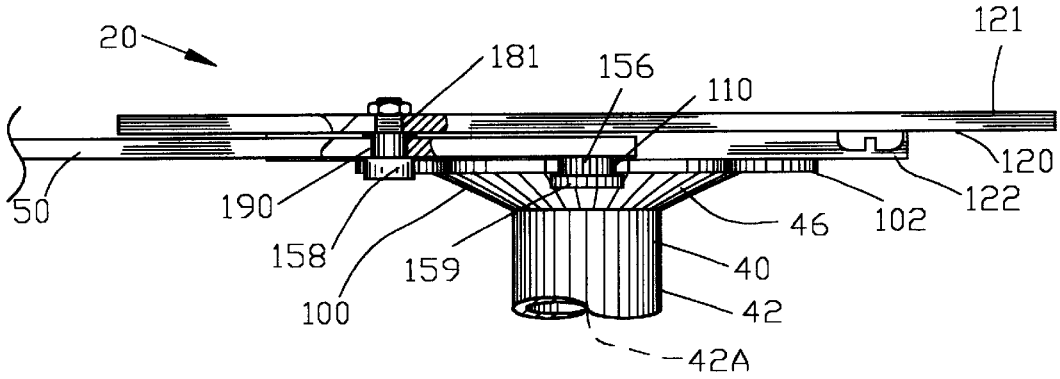
FIG. 9 is an enlarged view of a portion of FIG. 4.

FIG. 9 is an enlarged view of a portion of FIG. 4 illustrating a seat base 120 adapted to be secured to the seat portion 31. The seat base 120 comprises a first and a second base member 121 and 122. Preferably, the first base member 121 is a metallic member. Although the second base member 122 may be fabricated from a metallic member, preferably the second base member 122 is fabricated from a polymeric material. The second base member 122 is secured to the first base member 121 by suitable means such as mechanical fasteners such as screws or an adhesive or any other suitable means.

Figure 10:
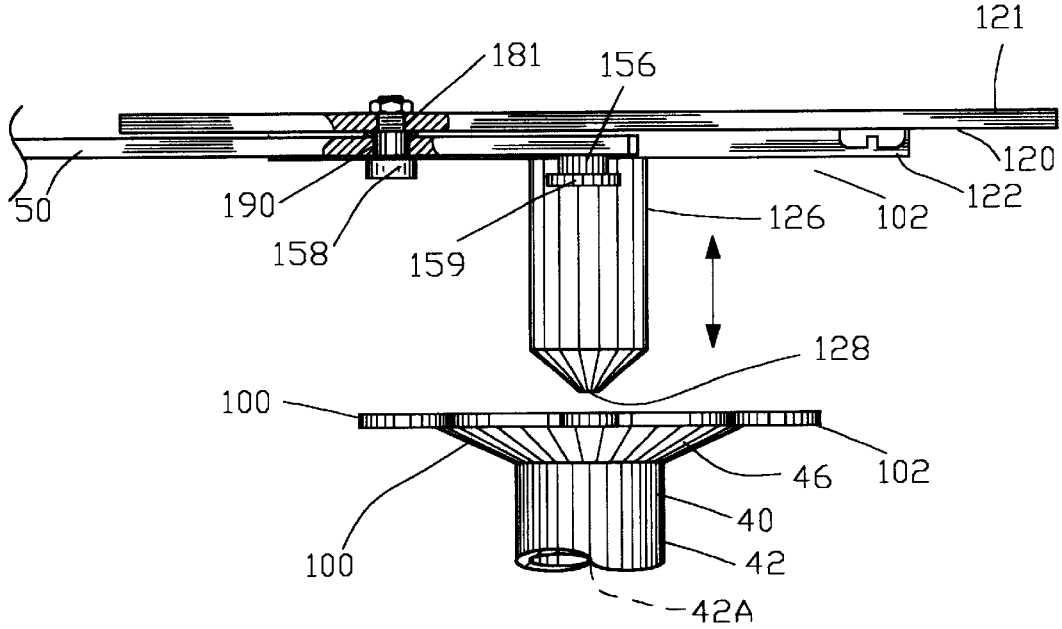
FIG. 10 is an view similar to FIG. 9 illustrating the seat being removed from the vertical pedestal.

FIG. 10 is a view similar to FIG. 9 illustrating the seat assembly 30 being removed from the pedestal 40. A shaft 126 extends from the first base member 121 of the seat base 120.

Although the shaft 126 may be connected to the first base member 122 of the seat base 120 by any suitable means such as mechanical fasteners or the like, preferably, the shaft 126 is connected to the first base member 121 of the seat base 120 by a weld.

The shaft 126 is adapted for rotational connection with the hollow tube 42 of the pedestal 40 for enabling the seat assembly 30 to rotate relative to the pedestal 40. The shaft 126 extends from the first base member 121 of the seat base 120 for insertion into the pedestal 40 for rotationally mounting the seat assembly 30 relative to the pedestal 40.

The shaft 120 includes a tapered tip 128 which cooperates with the partially conical member 46 of the pedestal 40 for facilitating insertion of the shaft 146 within the hollow tube 42 of the pedestal 40. The shaft 126 is removable from the hollow tube 42 for removing the seat 1 assembly 20 from the pedestal 40.

The second base member 122 forms a rotational bearing with the flange 100 for enhancing the rotation of the seat assembly 30 relative to the pedestal 40. The polymeric material of the second base member 122 provides a reduced bearing friction with the metallic flange 100.

The second base member 122 of the seat base 120 defines a right and left edge surface 141 and 142 for providing a right and a left stop and for the lever 50 when the operating lever 50 is located in the right-handed position and the left-handed position as shown in FIGS. 7 and 8. A right and a left seat base respites 144 and 146 are defined in the second base member 122 of the seat base 120 in the right and left edge surfaces 141 and 142.

As best shown in FIGS. 5–8, the lever 50 extends between a first and a second end 151 and 152. A handle portion 154 is located at the first end 151 of the lever 50 whereas a notch pin 156 is located at the second end 152 of the lever 50. A lever pivot 158 shown as an aperture is defined in the lever 50 between the first and second ends 151 and 152. The lever 50 includes a first and a second lever respite 161 and 162 adapted for receiving one end of a spring 170. The other end of the spring 170 is received in one of the right and left seat base respites 144 and 146 or in the second base member 122 of the seat base 120.

The lever 50 is a generally linear flat linear member and being symmetric for accommodating for a right-handed operator as shown in FIG. 7 or a left-handed operator as shown in FIG. 8. A right and a left pivot mounting 181 and 182 defined in the first base member 121 of the seat base 120. Each of the right and left pivot mountings 181 and 182 has an aperture for receiving a shoulder bolt 190 for affixing the lever pivot 158 either one of the right and left pivot mountings 181 and 182 of the first base member 121 of the seat base 120. The right and left edge surface 141 and 142 of the second base member 122 provide a right and a left stop and for the lever 50 when the lever 50 is secured to one of the right and left pivot mountings 181 and 182 of the first base member 121 of the seat base 120.

FIG. 7 illustrates the lever pivot 158 secured to the right pivot mountings 181 defined in the first base member 121 of the seat base 120. The lever 50 is mounted in a right position on the first base member 121 for accommodating for a right-handed operator seated in the seat assembly 30.

FIG. 8 illustrates the lever pivot 158 secured to the left pivot mountings 182 defined in the first base member 121 of the seat base 120. The lever 50 is mounted in a left position on the first base member 121 for accommodating for a left-handed operator seated in the seat assembly 30.

The notch pin 156 extends from the second end 152 of the lever 50 for being received by one of the plurality of notches 110 for locking the rotational position of the seat base 140 relative to the pedestal 40. The notch pin 156 is received within one of the plurality of notches 110 for positively locking the notch pin 156 within the notch 110.

The spring 170 coacts between one of the right and left seat base respites 144 and 146 of the seat base 120 and one of the first and second lever respites 161 and 162 of the lever 50 for urging the notch pin 156 into engagement with a selected one of the plurality of notches 110.

Figure 11:
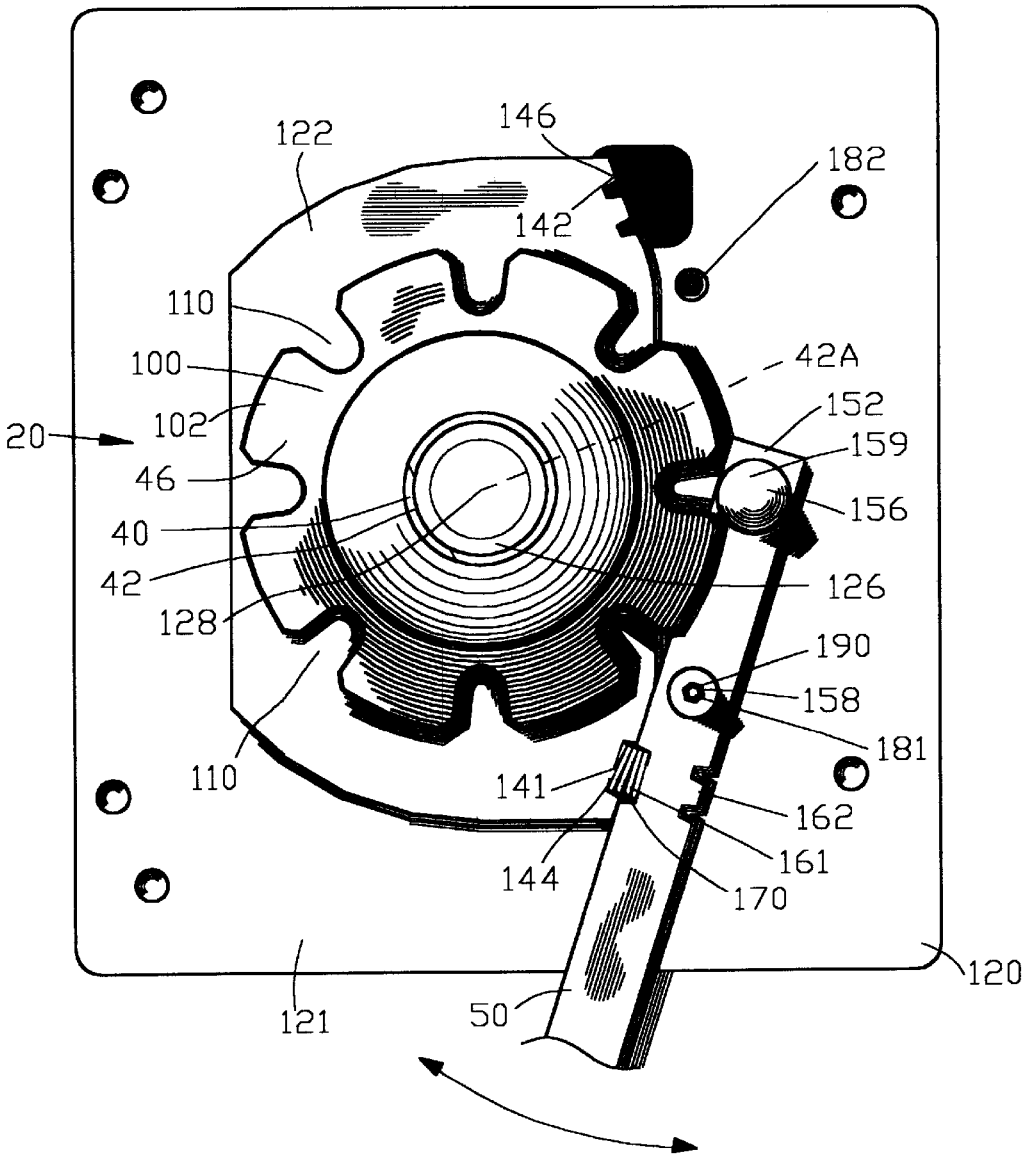
FIG. 11 is a view similar to FIG. 7 with the seat being disposed within the first rotational position and with the operating lever being located in an unlocked position for enabling rotation of the seat.

FIG. 11 is a view similar to FIG. 7 with the seat assembly 30 being disposed within the first rotational position and with the operating lever 50 being located in an unlocked position for enabling rotation of the seat assembly 30. Preferably, each of the plurality of notches 110 includes a partially circular surface 200 interposed between inner tapered surfaces 201 and 202. The inner tapered surfaces 201 and 202 are interposed by outer tapered surfaces 211 and 212. The outer tapered surfaces 211 and 212 and the inner tapered surfaces 201 and 202 of each of the plurality of notches 110 facilitate the insertion of the notch pin 156 within the plurality of notches 110 and for positively locking the notch pin 156 within the partially circular surface 200 of the selected one of the plurality of notches 10.

Figure 12:
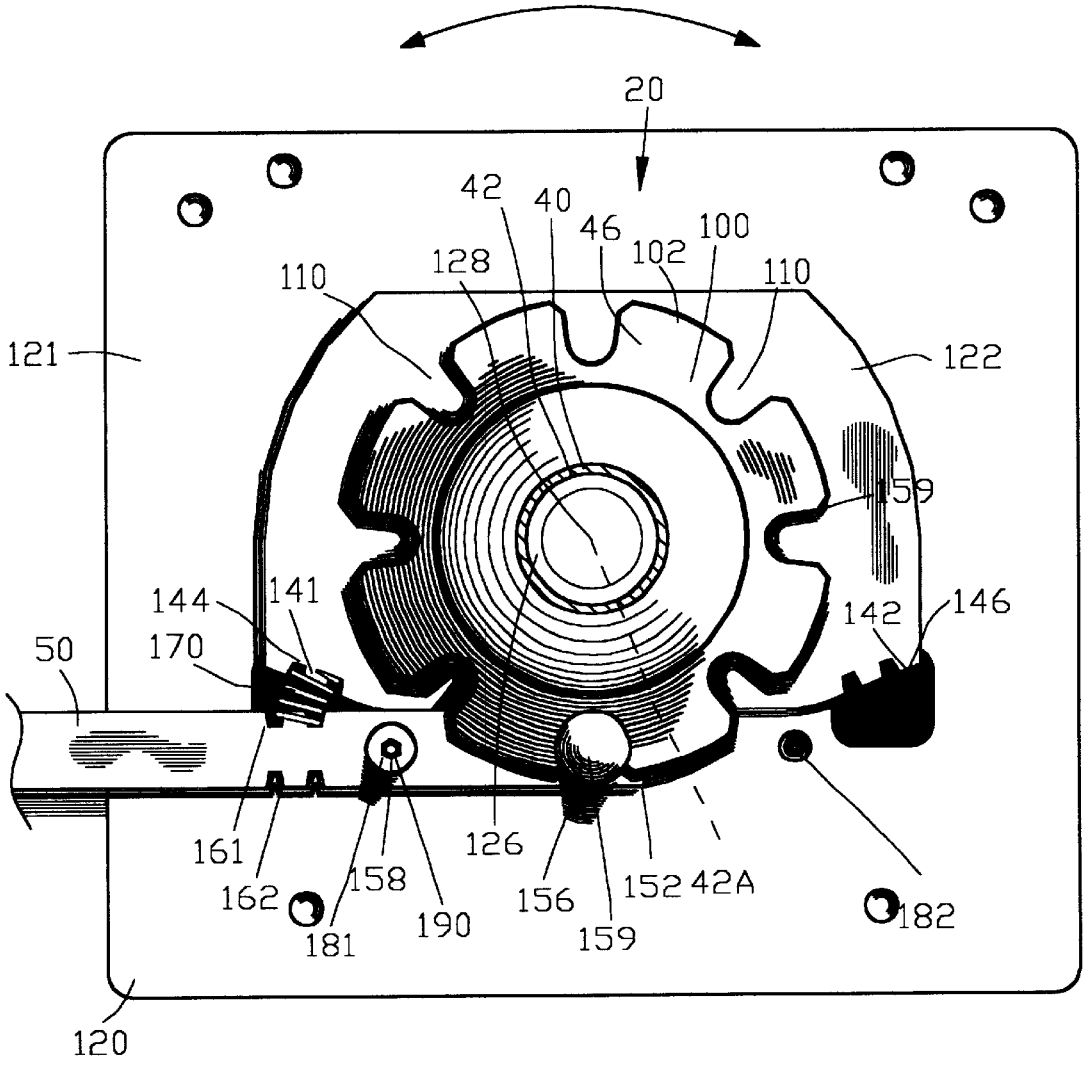
FIG. 12 is a view similar to FIG. 11 with the seat being disposed within the second rotational position and with the operating lever being located in a locked position for securing the rotational position of the seat.

FIG. 12 is a view similar to FIG. 11 with the seat assembly 30 being disposed within the second rotational position and with the operating lever 50 being located in a locked position for securing the rotation of the seat assembly 30. The spring 170 coacts between the seat base respites 144 of the seat base 120 and the lever respites 161 of the lever 50 for urging the notch pin 156 into engagement with a selected on of the plurality of notches 110.

As best shown in FIGS. 9 and 10, the notch pin 156 includes an enlarged head 159 having a greater dimension than the notch 110. The enlarged head 159 of the notch pin 156 inhibits the removal of the seat base 120 from the pedestal 140 when the notch pin 156 is engaged with the notch 110 as shown in FIG. 9. In order to remove the seat base 120 from the pedestal 140, the operating lever 50 must be located in the unlocked position as shown in FIG. 11 for enabling the seat base 120 to be lifted from the pedestal 140 as shown in FIG. 10.

Figure 13:
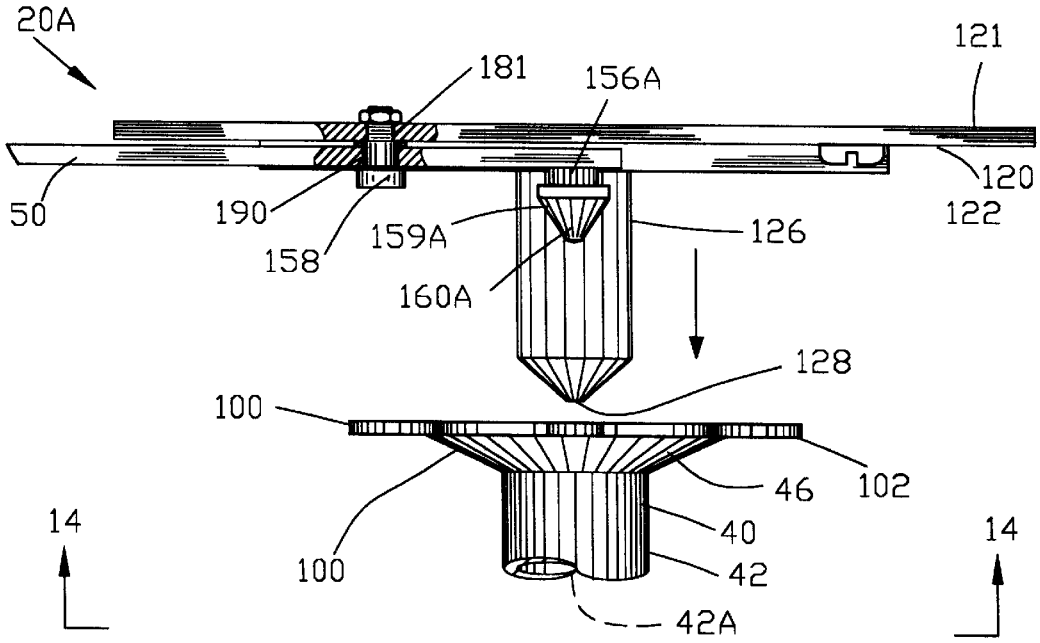
FIG. 13 is a second embodiment of the invention illustrating the seat positioned above the vertical pedestal.

FIG. 13 is a second embodiment of the invention illustrating a rotational adjustment device 20A with similar parts being labeled with similar reference numerals. In this embodiment of the invention, the notch pin 156A defines an enlarged head 159A having a greater dimension than the notch 110. The enlarged head 159A of the notch pin 156A includes a contoured end 160A.

FIG. 13 illustrates the seat assembly 30 being positioned over the pedestal 40. The shaft 126 extending from the first base member 121 of the seat base 120 is positioned over the vertical pedestal 40.

Figure 14:
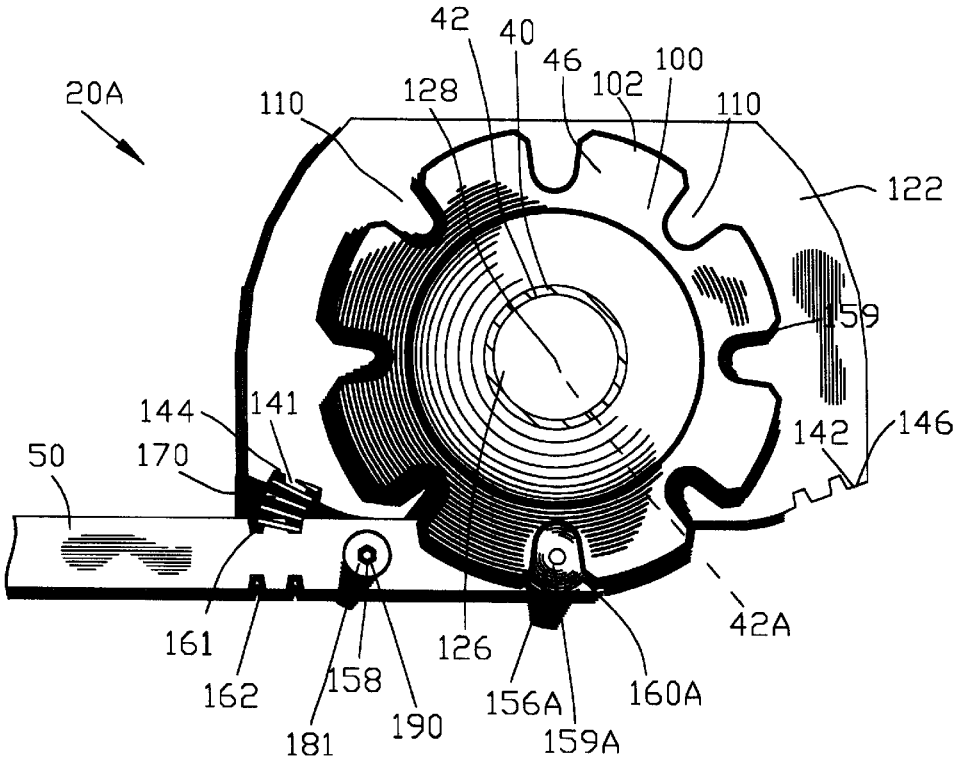
FIG. 14 is a bottom view of FIG. 13.

FIG. 14 is a bottom view of FIG. 13 illustrating the contoured end 160A of the notch pin 156A positioned over a notch 110 in the metallic flange 100. In the event the contoured end 160A of the notch pin 156A is not positioned over a notch 110 in the metallic flange 100, the seat assembly 30 may be rotated to bring the contoured end 160A of the notch pin 156A into position over a notch 110.

Figure 15:
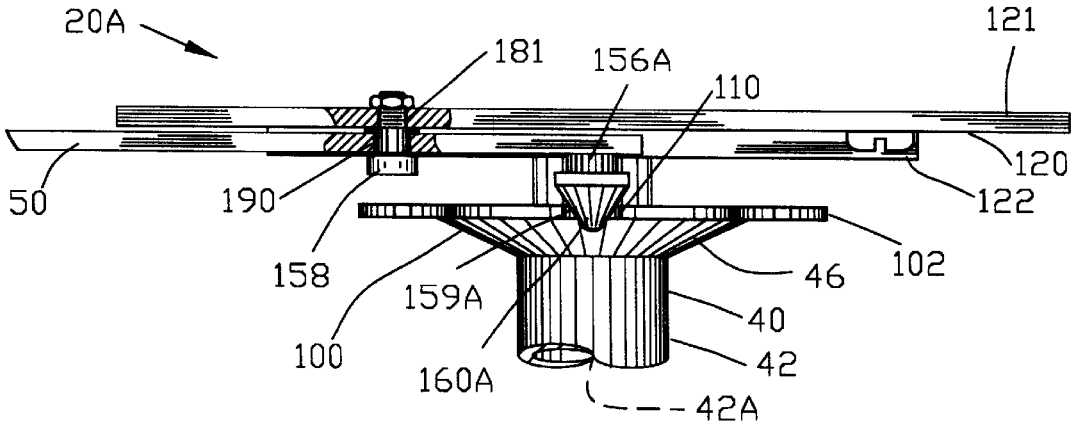
FIG. 15 is a view similar to FIG. 13 illustrating a shaft being inserted into a vertical pedestal with a tapered end of a notch pin causing rotation of the operating lever.
Figure 16:
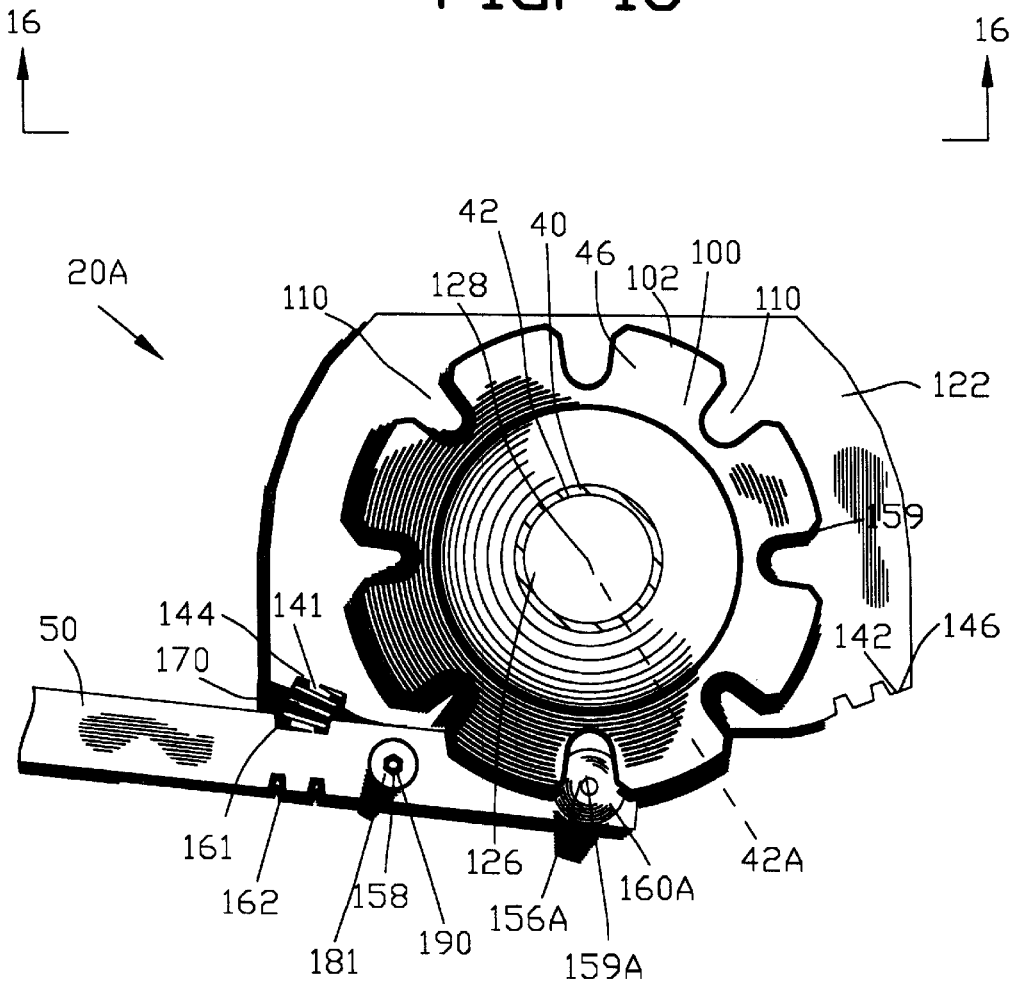
FIG. 16 is a bottom view of FIG. 15.

FIGS. 15 and 16 are similar to FIGS. 13 and 14 illustrating the shaft 126 being inserted into the vertical pedestal 40. The contoured end 160A of the notch pin 156A engages the notch 110 in the metallic flange 100. The downward movement of the seat assembly 30 in combination with the contoured end 160A of the notch pin 156A rotates the lever 50 about the lever pivot 158 to move the notch pin 156A radially outwardly from the vertical pedestal 40.

Figure 17:
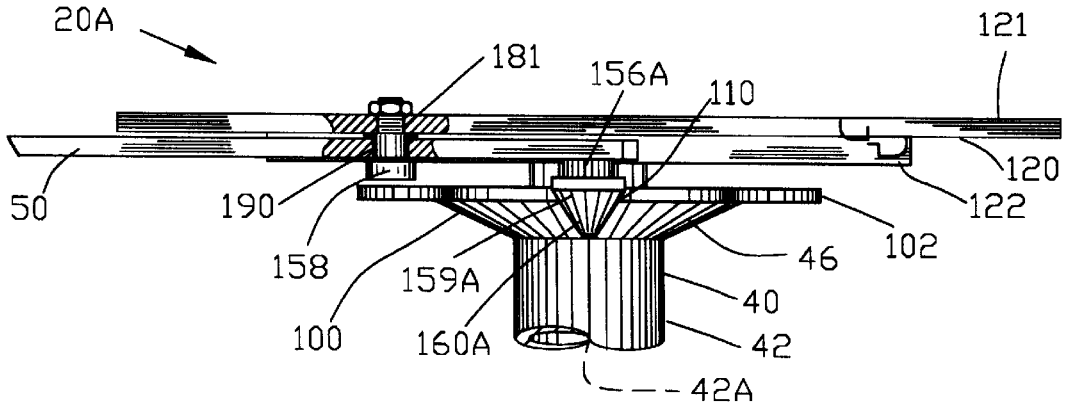
FIG. 17 is a view similar to FIG. 15 illustrating a further insertion of the shaft and a further rotation of the operating lever.
Figure 18:
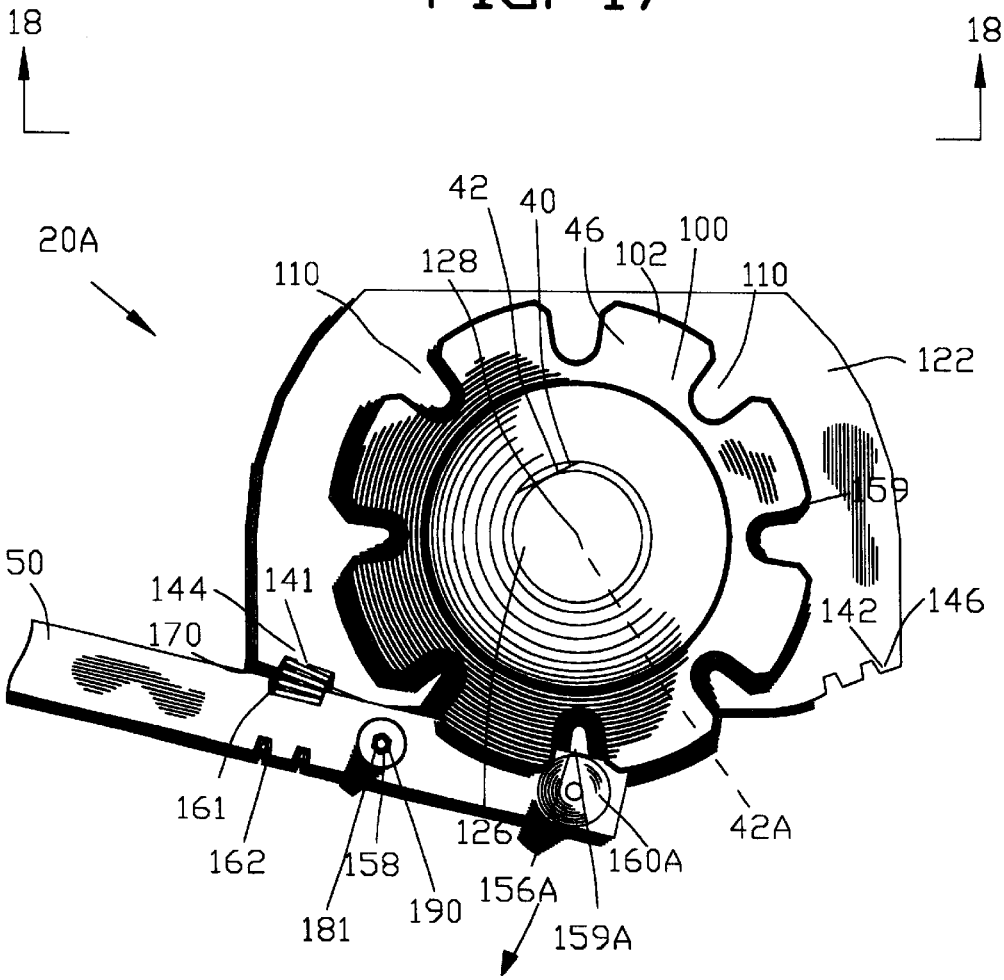
FIG. 18 is a bottom view of FIG. 17.

FIGS. 17 and 18 are similar to FIGS. 15 and 16 illustrating the shaft 126 being inserted further into the vertical pedestal 40. The contoured end 160A of the notch pin 156A continues to engage the notch 110 in the metallic flange 100. The continued downward movement of the seat assembly 30 continues to rotate the operating lever 50 about the lever pivot 158 until the enlarged head 159A of the notch pin 156A moves past the metallic flange 100.

Figure 19:
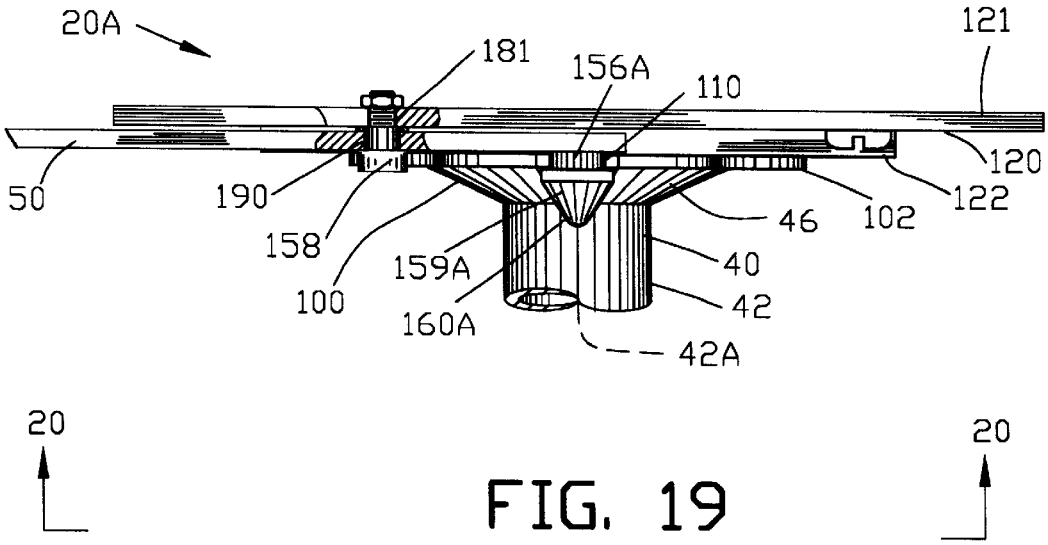
FIG. 19 is a view similar to FIG. 17 illustrating the notch pin being disposed within a notch of the flange for securing the rotational position of the seat.
Figure 20:
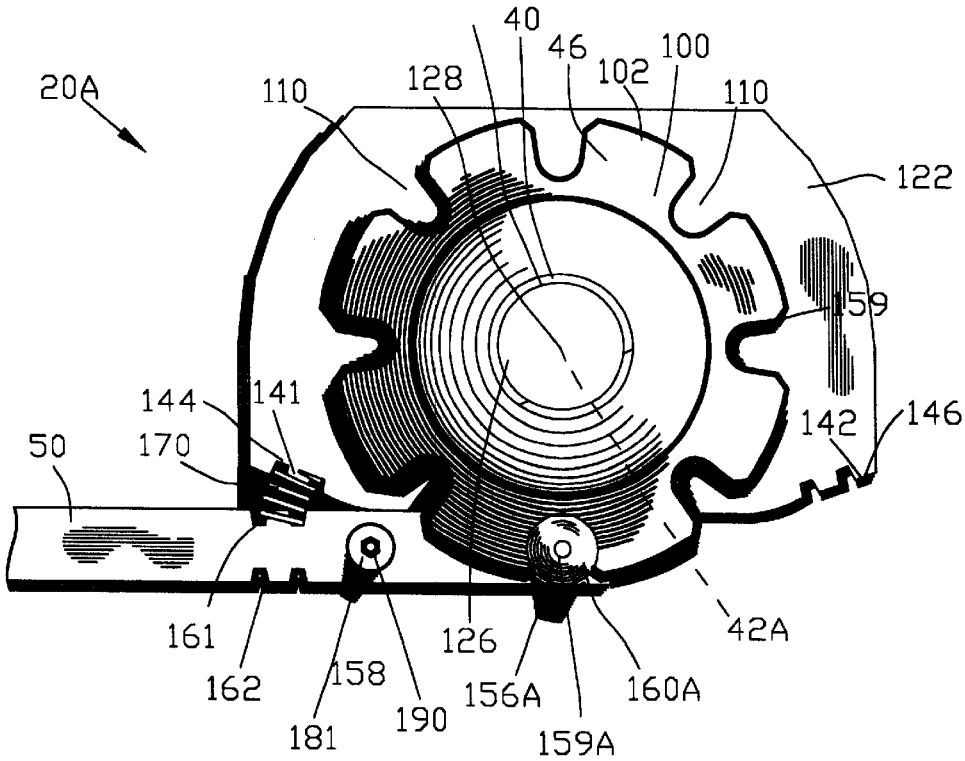
FIG. 20 is a bottom view of FIG. 19.

FIGS. 19 and 20 are similar to FIGS. 17 and 18 illustrating the shaft 126 being fully inserted into the vertical pedestal 40. The notch pin 156A is received by the notches 110 for locking the rotational position of the seat assembly 30 relative to the pedestal 40. The contoured end 160A of the notch pin 156A provides for the automatic insertion of the shaft 126 within the vertical pedestal 40 without manually moving the operating lever 50.

Although the invention has been described in its preferred form with a certain degree of particularity, it is understood that the present disclosure of the preferred form has been made only by way of example and that numerous changes in the details of construction and the combination and a management of parts may be resorted to without departing from the spirit and scope of the invention.

What is claimed is:

1. An apparatus for adjusting the rotational position of a seat, comprising:

a pedestal defining a pedestal axis extending through said pedestal;

a flange supported by said pedestal with said flange extending radially outwardly relative to said pedestal axis;

a seat base adapted to be secured to the seat;

a shaft extending from said seat base and adapted for rotational connection with said pedestal for enabling the seat to rotate relative to said pedestal;

a plurality of notches defined in a spaced apart relationship about said flange;

a lever having a handle portion located at a first end of said lever and a notch pin located remote from said first end of said lever with a lever pivot defined therebetween;

a right and a left pivot mounting defined in said seat base;

said lever pivot being secured to one of said right and left pivot mountings for mounting said lever pivot in one of a right position and a left position on said seat base for accommodating for a right-handed operator or a left-handed operator seated in the seat; and said notch pin engaging with one of said plurality of notches for locking the rotational position of said seat base relative to said pedestal.

2. An apparatus for adjusting the rotational position of a chair as set forth in claim 1, wherein said pedestal is a hollow tube.

3. An apparatus for adjusting the rotational position of a chair as set forth in claim 1, wherein said pedestal is a substantially vertical pedestal.

4. An apparatus for adjusting the rotational position of a chair as set forth in claim 1, wherein said shaft extends from said seat base for insertion into said pedestal for rotationally mounting said seat base relative to said pedestal.

5. An apparatus for adjusting the rotational position of a chair as set forth in claim 1, wherein said shaft extends from said seat base for insertion into said pedestal for rotationally mounting said seat base relative to said pedestal; and said shaft being removable from said pedestal for removing said seat from said pedestal.

6. An apparatus for adjusting the rotational position of a chair as set forth in claim 1, wherein said shaft extends from said seat base for insertion into said pedestal for rotationally mounting said seat base relative to said pedestal;

said shaft being removable from said pedestal for removing said seat from said pedestal; and said notch pin includes an enlarged end having a greater dimension than said notch for inhibiting removal of said seat base from said pedestal when said notch pin is engaged with said notch.

7. An apparatus for adjusting the rotational position of a chair as set forth in claim 1, wherein said shaft extends from said seat base for insertion into said pedestal for rotationally mounting said seat base relative to said pedestal;

said flange being connected to said pedestal by a partially conical member for facilitating the insertion of said shaft within said pedestal; and said shaft being removable from said pedestal for removing said seat from said pedestal.

8. An apparatus for adjusting the rotational position of a chair as set forth in claim 1, wherein said flange is formed of a metallic material; and said seat base having a portion thereof being formed from a polymeric material; and said seat base rotatably engaging with said flange with said polymeric material providing a bearing surface with metallic flange.

9. An apparatus for adjusting the rotational position of a chair as set forth in claim 1, wherein said seat base defines a right and left edge surface for providing a right and a left stop for said lever when the lever is secured to one of said right and left positions on said seat base.

10. An apparatus for adjusting the rotational position of a chair as set forth in claim 1, wherein said flange is a substantially circular flange having an outer circumference;

said plurality of notches extending radially inwardly from said outer circumference of said substantially circular flange.

11. An apparatus for adjusting the rotational position of a chair as set forth in claim 1, wherein said flange is a substantially circular flange having an outer circumference;

said plurality of notches extending radially inwardly from said outer circumference of said substantially circular flange; and each of said notches being tapered for facilitating insertion of said notch pin within said notch and for positively locking said notch pin within said notch.

12. An apparatus for adjusting the rotational position of a chair as set forth in claim 1, wherein said lever is a generally linear flat linear member being symmetric for accommodating for a right-handed operator or a left-handed operator seated in the chair when said lever is secured to one of said right and left positions on said seat base.

13. An apparatus for adjusting the rotational position of a chair as set forth in claim 1, wherein said right and left pivot mounting includes a right and a left aperture; and a shoulder bolt for affixing said lever pivot to one of said right and left apertures for pivoting said lever in one of a right position and a left position on said seat base.

14. An apparatus for adjusting the rotational position of a chair as set forth in claim 1, including a spring coacting between said seat base and said lever for urging said notch pin into engagement with said notch.

15. An apparatus for adjusting the rotational position of a chair as set forth in claim 1, wherein said lever includes a first and a second lever respite for receiving one end of a spring;

a right and a left seat base respite defined in said seat base for receiving another end of said spring; and said spring being contained between said one of said lever respites and one of said seat base respites for urging said notch pin into engagement with said notch.

16. An apparatus for adjusting the rotational position of a chair as set forth in claim 1, wherein said shaft extends from said seat base for insertion and removal from said pedestal for removably and rotationally mounting said seat base relative to said pedestal; and said notch pin including an enlarged contoured end for enabling said contour to pivot said lever upon insertion of said shaft into said pedestal for facilitating said notch pin to engage with one of said plurality of notches for locking the rotational position of said seat base relative to said pedestal.

17. An apparatus for adjusting the rotational position of a chair as set forth in claim 1, wherein said shaft extends from said seat base for insertion and removal from said pedestal for removably and rotationally mounting said seat base relative to said pedestal;

said notch pin including an enlarged contoured end for enabling said contour to pivot said lever upon insertion of said shaft into said pedestal for facilitating said notch pin to engage with one of said plurality of notches for locking the rotational position of said seat base relative to said pedestal; and said notch pin includes an enlarged end having a greater dimension than said notch for inhibiting removal of said seat base from said pedestal when said notch pin is engaged with said notch.

18. An apparatus for adjusting the rotational position of a seat, comprising:

a pedestal defining a pedestal axis extending through said pedestal;

a flange supported by said pedestal with said flange extending radially outwardly relative to said pedestal axis;

a seat base adapted to be secured to the seat;

a shaft extending from said seat base and adapted for rotational connection with said pedestal for enabling the seat to rotate relative to said pedestal;

said shaft extending from said seat base for insertion and removal from said pedestal for removably and rotationally mounting said seat base relative to said pedestal;

a plurality of notches defined in a spaced apart relationship about said flange;

a lever having a handle portion located at a first end of said lever and a notch pin located remote from said first end of said lever with a lever pivot defined therebetween;

a pivot mounting defined in said seat base;

said lever pivot being secured to said pivot mounting for mounting said lever pivot on said seat base;

said notch pin engaging with one of said plurality of notches for locking the rotational position of said seat base relative to said pedestal;

said notch pin including an enlarged contoured end for enabling said contour to pivot said lever upon insertion of said shaft into said pedestal for facilitating said notch pin to engage with one of said plurality of notches for locking the rotational position of said seat base relative to said pedestal; and said notch pin including an enlarged end having a greater dimension than said notch for inhibiting removal of said seat base from said pedestal when said notch pin is engaged with said notch.

19. An apparatus for adjusting the rotational position of a seat, comprising:

a pedestal defining a pedestal axis extending through said pedestal;

a flange supported by said pedestal with said flange extending radially outwardly relative to said pedestal axis;

a seat base adapted to be secured to the seat;

a shaft extending from said seat base and adapted for rotational connection with said pedestal for enabling the seat to rotate relative to said pedestal;

said shaft extending from said seat base for insertion and removal from said pedestal for removably and rotationally mounting said seat base relative to said pedestal;

a plurality of notches defined in a spaced apart relationship about said flange;

a lever having a handle portion located at a first end of said lever and a notch pin located remote from said first end of said lever with a lever pivot defined therebetween;

a pivot mounting defined in said seat base;

said lever pivot being secured to said pivot mounting for mounting said lever pivot on said seat base;

said notch pin engaging with one of said plurality of notches for locking the rotational position of said seat base relative to said pedestal;

said notch pin including an enlarged contoured end for enabling said contour to pivot said lever upon insertion of said shaft into said pedestal for enabling said shaft extending from said seat base to be inserted into said pedestal irrespective of the position of said lever; and said notch pin including an enlarged end having a greater dimension than said notch for inhibiting removal of said seat base from said pedestal when said notch pin is engaged with said notch.

* * * * *